US006469599B1

(12) United States Patent
Otto et al.

(10) Patent No.: US 6,469,599 B1
(45) Date of Patent: Oct. 22, 2002

(54) ASSEMBLY FOR THE PRESSURE-TIGHT SEPARATION OF A FIRST WAVEGUIDE FROM A SECOND WAVEGUIDE AND METHOD OF PRODUCING SUCH AN ASSEMBLY

(75) Inventors: Johanngeorg Otto, Essingen; Stefan Burger, Freiburg; Thomas Werner, Rümmingen, all of (DE)

(73) Assignee: Endress + Hauser GmbH + Co., Maulburg (DE)

( * ) Notice: Subject to any disclaimer, the term of this patent is extended or adjusted under 35 U.S.C. 154(b) by 0 days.

(21) Appl. No.: 09/514,746

(22) Filed: Feb. 28, 2000

(30) Foreign Application Priority Data

Mar. 16, 1999 (DE) ..... 199 11 744

(51) Int. Cl.[7] ..... H01P 1/04; H01P 1/08
(52) U.S. Cl. ..... 333/254; 333/252
(58) Field of Search ..... 333/257, 254, 333/251, 33, 210, 252

(56) References Cited

U.S. PATENT DOCUMENTS 3,597,710 A * 8/1971 Levy ..... 333/210
4,676,663 A * 6/1987 Tehon ..... 374/119
4,688,009 A 8/1987 Ferguson et al. ..... 333/252
4,795,078 A * 1/1989 Kuroki et al. ..... 228/131
4,799,036 A 1/1989 Owens ..... 333/260
5,872,494 A * 2/1999 Palan et al. ..... 333/252

FOREIGN PATENT DOCUMENTS

WO WO 98/14762 4/1998 ..... G01F/23/284

* cited by examiner

*Primary Examiner*—Robert Pascal
*Assistant Examiner*—Dean Takaoka
(74) *Attorney, Agent, or Firm*—Bose McKinney & Evans LLP

(57) ABSTRACT

The invention concerns an assembly for the pressure-tight separation of a first waveguide (12) from a second waveguide (16), having a pressure-resistant conductor body (22) and a first adaptor (26), which is arranged between the first waveguide (12) and the end of the conductor body (22) facing the latter, and a second adaptor (30), which is arranged between the second waveguide (16) and the end of the conductor body (22) facing the latter, the dielectric constants of the first and second adaptors (26, 30) lying between those of the conductor body (22) and the waveguides (12, 16). An assembly of this kind can be used in particular for an electronic device with a contact pin (10) and an antenna (18), the contact pin (10) radiating into a first waveguide (12) and the antenna (18) being connected to a second waveguide (16) and a pressure-tight bushing for microwave radiation being required between the first and second waveguides (12, 16).

53 Claims, 2 Drawing Sheets

ASSEMBLY FOR THE PRESSURE-TIGHT SEPARATION OF A FIRST WAVEGUIDE FROM A SECOND WAVEGUIDE AND METHOD OF PRODUCING SUCH AN ASSEMBLY

FIELD OF THE INVENTION

The invention concerns an assembly for the pressure-tight separation of a first waveguide from a second waveguide, a pressure-resistant conductor body being arranged between the first waveguide and the second waveguide. The invention also concerns a method of producing an assembly of this kind.

BACKGROUND OF THE INVENTION

An assembly of this kind serves for coupling electromagnetic waves, for example microwaves, which are generated by an electronic circuit, into hermetically separated areas, for example hazardous areas or closed metal containers.

In the prior art, two ways of conducting the electromagnetic waves through a barrier closing off such an area are known in particular. One way of achieving vacuum-tight feeding into a waveguide is to use a metal pin fused into glass as a glass bushing. Glass bushings of this kind are offered in a wide variety of designs, for example by the Schott company. One problem of a glass bushing of this kind is that it is very limited in the extent to which it can be subjected to pressure and temperature. Since the coefficient of thermal expansion of glass and of the metal pin fused in it differ, thermal loading causes high stresses which may lead to damage. This can be compensated only to a limited extent by a shrunk-on metal ring which applies a compressive stress to the insulator formed by the glass. Temperatures in the range from 100 to 200° C. are usually permissible; in extreme cases, glass bushings of this kind can be subjected to a maximum of 350° C. In this case it must be ensured, however, that a high pressure is not simultaneously applied to the glass bushing. There is a further problem with regard to the permeability with respect to microwaves. Good permeability requires the metal pin to be of a short length. This, however, gives rise to problems with regard to the available soldering length. If, on the other hand, the length of the pin is increased to provide the soldering length required by some approval procedures, the permeability with respect to microwaves decreases greatly.

Another way is to arrange in the waveguide a window which is permeable with respect to electromagnetic waves, in particular microwaves. A window of this kind generally comprises a soldered-in or fused-in glass element in the waveguide. The biggest problem with windows of this kind is the low pressure resistance. Windows of this kind can usually only be exposed to a pressure of a few bars. This is attributable to the fact that the glass elements have only a very small thickness. This small thickness is required, however, for the high bandwidths usually desired.

SUMMARY OF THE INVENTION

The object of the invention is to provide a pressure-tight waveguide bushing which has a temperature resistance in the range of 250° C. and above as well as a pressure resistance in the range from 60 to 100 bar. At the same time, the bandwidth is to be adaptable to the respective requirements without any great effort.

This object is achieved according to the invention by an assembly for the pressure-tight separation of a first waveguide from a second waveguide, having a pressure-resistant conductor body and a first adaptor, which is arranged between the first waveguide and the end of the conductor body facing the latter, and a second adaptor, which is arranged between the second waveguide and the end of the conductor body facing the latter, the dielectric constants of the first and second adaptors lying between those of the conductor body and the waveguides.

In simplified terms, the assembly according to the invention is based on providing various components for the various functions which have to be performed by a bushing through a waveguide. The pressure resistance is ensured by the conductor body, the material of which can be adapted specifically to requirements. Apart from ceramic, the material glass, in particular quartz glass, is particularly suitable as the material for the conductor body. The adaptors serve to compensate for the transitional locations. Their dielectric constant is chosen such that the optimum transmission behavior is achieved. Plastic, in particular polytetrafluoroethylene, may be used as the material for the adaptor.

According to a preferred embodiment, it is provided that the conductor body has a circular cross section and is surrounded by a metal sheath. With this design, particularly high strength of the assembly is obtained. Furthermore, the metal sheath can be used particularly well for connection to other components, for example by welding.

It is preferably provided that the metal sheath exerts a compressive stress on the conductor body. This design takes into account the fact that, although the materials ceramic and glass, which are preferably used for the conductor body, have a very high compressive strength, they have a very low tensile strength. If a compressive stress is applied to the conductor body by the metal sheath, this compressive stress is superposed on all the stresses which can act on the conductor body during operation. Even if tensile stresses are introduced into the conductor body in the process, the resultant loading is in any event a compressive stress, so that damage to the conductor body is ruled out.

The compressive stress to be exerted by the metal sheath may preferably be generated by the conductor body and the metal sheath being dimensioned in a way appropriate for a press fit. Suitable in particular as the material for the metal sheath which withstands the stresses occurring is an alloy known as Hastelloy or an alloy with the material number 1.4571.

To achieve the desired gas-tight and pressure-resistant separation, customary testing and approval procedures require the conductor body to be of a minimum length of 10 to 15 mm. For microwaves in the K band, this means that the length of the conductor body is a multiple of the diameter. The length of the conductor body can be chosen for a specific frequency (center frequency) such that it is $\lambda/4$ or $\lambda/4+$ a multiple of $\lambda/2$. The reflections at the boundary surfaces opposite one another thus cancel one another out, so that transmission is optimal, in other words reflection attenuation is very great. With a diameter of the conductor body in the range between 4 and 4.5 mm, this gives a length in the range between 8 and 20 mm, preferably between 10 and 15 mm. It should be noted that a change in frequency results in a change in the reflection attenuation if the length of the conductor body remains the same. The longer the conductor body, the smaller the attainable bandwidth.

The adaptors arranged at both ends of the conductor body are preferably captively held in adaptor holders. The adaptors may be formed as stepped cylinders with a first portion and a second portion, the first portion in each case having a greater diameter than the second portion and the first portion in each case facing the conductor body.

An assembly such as that which has been described above may be, in particular, an electrical device with a contact pin and an antenna, the contact pin radiating into the first waveguide and the antenna being connected to the second waveguide, and the assembly being arranged between the first and the second waveguides. In this way, a transmitter can radiate via the contact pin and the antenna into a container, which for example is closed off with a pressure-tight seal.

In the case of a method according to the invention of producing an assembly such as that described above, the conductor body is introduced into a metal sheath in such a way that the metal sheath applies a compressive stress to the conductor body. This method is preferably carried out as follows: firstly, the metal sheath is heated to such a temperature that its inside diameter is greater than the outside diameter of the conductor body. Then the conductor body is inserted into the metal sheath. Finally, the metal sheath is cooled, so that it shrinks onto the conductor body. This method makes it possible to set the compressive stresses exerted by the metal sheath on the conductor body appropriately for the respective conditions, in that the inside diameter of the metal sleeve is produced with a predetermined undersize with respect to the outside diameter of the conductor body. A conductor body made of quartz glass is preferably used for this method.

Advantageous embodiments of the invention emerge from the dependent claims.

BRIEF DESCRIPTION OF THE DRAWINGS

The invention is described below with reference to a preferred embodiment, which is represented in the attached drawings, in which.

DETAILED DESCRIPTION OF THE PREFERRED EMBODIMENT

Figure 1:
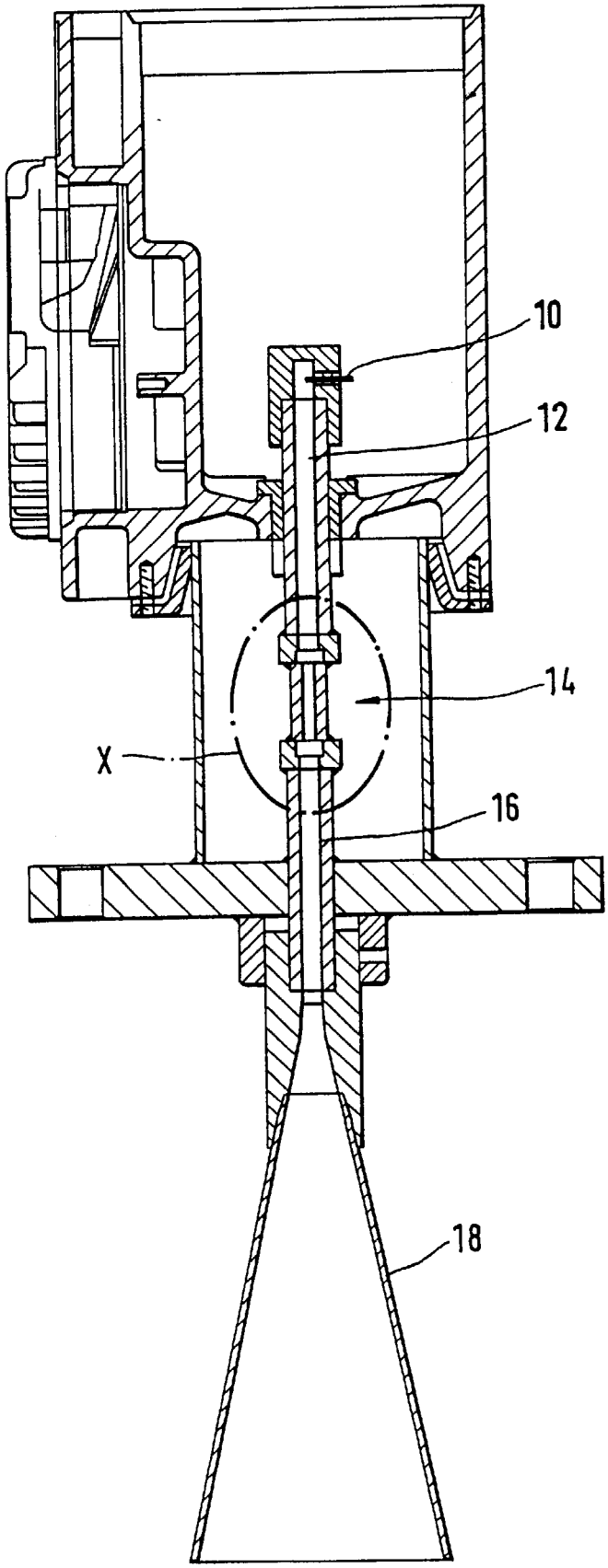
FIG. 1 shows in a longitudinal section an electronic device in which an assembly according to the invention is used.

FIG. 1 shows an electronic device in which an assembly according to the invention is used. The electronic device is in this case a filling level gage which operates on the principle of a radar system. Provided for this purpose is a transmission circuit (not shown), which is coupled by a metal pin 10 to a first waveguide 12. The first waveguide 12 is coupled by a pressure-tight assembly 14, which is described in detail later, to a second waveguide 16, which in turn is connected to an antenna 18. The antenna is intended to be arranged in the interior of a space closed off with a pressure-tight seal. For this reason, the second waveguide 16 is closed off with a pressure-tight seal by means of the assembly 14.

Figure 2:
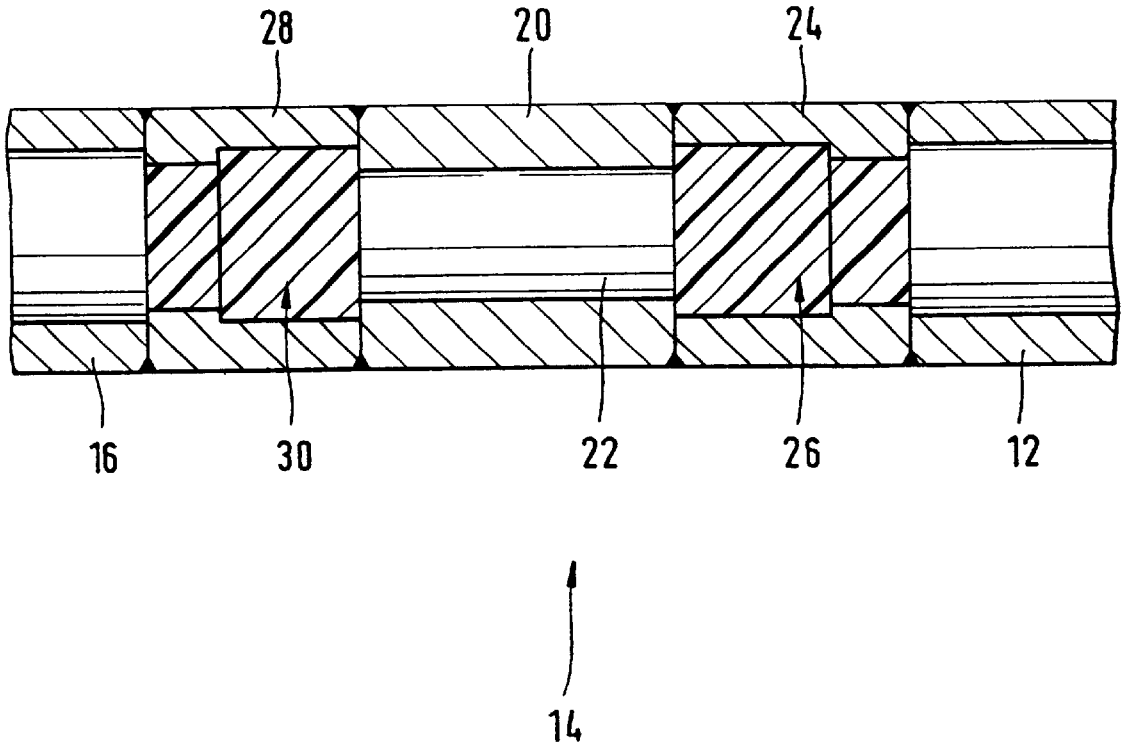
FIG. 2 schematically shows the region X from FIG. 1 on an enlarged scale.

This assembly 14 (see FIG. 2 in particular) includes a metal sheath 20, which encloses a conductor body 22. Arranged between the first waveguide 12 and the metal sheath 20 is a first adaptor holder 24, which encloses a first adaptor 26. Arranged between the metal sheath 20 and the second waveguide 16 is a second adaptor holder 28, which encloses an adaptor 30. Both the metal sheath 20 and the two adaptor holders 24, 28 have a circular cross section. The conductor body 22 has a cylindrical shape, and the two adaptors 26, 30 each have a stepped-cylindrical shape, the portion with the greater diameter in each case being arranged adjacent to the conductor body 22. In this way, the adaptors are captively held in the adaptor holders without any further measures.

The sleeve-shaped metal sheath preferably consists of an alloy known as Hastelloy or an alloy with the material number 1.4571. These alloys have a particularly high heat resistance.

The conductor body 22 may consist of ceramic. It preferably consists of glass, in particular quartz glass.

The unit comprising the metal sheath 20 and conductor body 22 is produced as follows: Firstly, a glass rod with the desired diameter and the desired length is prepared. For example, the diameter may be 4.35 mm ±0.01 mm, and the length is 18 mm ± 0.2 mm. The metal sheath 20 is produced with an undersize of 0.03 to 0.04 mm. Consequently, the inside diameter of the metal sheath is 4.32 ±0.01 mm. If the metal sheath 20 is heated, for example in an oven, to 700 to 800° C., it expands to such an extent that the conductor body 22 made of quartz glass can be freely inserted into the metal sheath 20. When the metal sheath 20 is then cooled, it shrinks firmly onto the conductor body 22. On account of the undersize chosen, after cooling the metal sheath 20 exerts a compressive stress on the conductor body 22. This compressive stress ensures on the one hand that the conductor body 22 is seated firmly in the metal sheath 20, so that it is securely held even under high compressive loading, and on the other hand that the conductor body 22 is prestressed in such a way that no tensile stresses which could lead to destruction of the conductor body 22 can occur during operation.

If required, the end faces of the conductor body 22 may also be polished after the metal sheath 20 has been fitted.

It has been found in tests that units produced in this way from the conductor body 22 and metal sheath 20 can be loaded with pressures of up to well in excess of 300 bar. A helium tightness of up to $10^{-9}$ mbar.1/sec was obtained before and after the tests.

To improve the RF transmission properties, the shrinking on of the metal sheath may be carried out in an inert atmosphere, that is to say under inert gas. Alternatively, the metal sheath may be gold-plated or metallized in some other way on the inside in advance.

The adaptors 26, 30 are fitted onto the end faces of the conductor body 22. These adaptors preferably consist of plastic, in particular polytetrafluoroethylene. The dielectric constant of the adaptors 26, 30 is chosen such that it lies between those of the waveguides 12, 16 and of the conductor body 22. In this way, special transitional structures known from RF technology, for example step-like or conical structures, can be avoided. This is required because such structures cannot be obtained with the conductor body 22 consisting of ceramic or glass if it is to be able to withstand high loads.

The material of the waveguides 12, 16, of the adaptor holders 24, 28 and of the metal sheath 20 is weldable, so that all the parts can be connected to one another in the correct sequence by simple-to-form weld seams. In this way, the assembly 14 by which the two waveguides 12, 16 are connected to one another with the desired transmission bandwidth is obtained without any great effort, a pressure-tight termination of the second waveguide 16 being achieved.

What is claimed is:

1. An assembly for the pressure-tight separation of a first waveguide (12) from a second waveguide (16), the assembly comprising a pressure-resistant conductor body (22), a first adaptor (26), which is arranged between the first waveguide (12) and the end of the conductor body (22) facing the latter, a second adaptor (30), which is arranged between the second waveguide (16) and the end of the conductor body (22) facing the latter, the dielectric constants of the first and second adaptors (26, 30) lying between those of the conductor body (22) and the waveguides (12, 16), and a metal sheath (20) having an inside diameter that is greater than an outside diameter of the conductor body (22) when the metal sheath (20) is heated, the conductor body (22) being surrounded by the metal sheath (20), and the metal sheath (20) exerting a compressive stress on the conductor body (22) when the metal sheath (20) is cooled.

2. The assembly as claimed in claim 1, wherein the conductor body (22) consists of ceramic.

3. The assembly as claimed in claim 2, wherein the conductor body (22) has a circular cross section and is surrounded by a metal sheath (20).

4. The assembly as claimed in claim 2, wherein the conductor body (22) has a diameter between 4 and 4.5 mm with a length between 8 and 20 mm.

5. The assembly as claimed in claim 2, wherein the adaptors (26, 30) consist of a plastic.

6. The assembly as claimed in claim 2, wherein the adaptors (26, 30) are captively held in the adaptor holders (24, 28).

7. A method of producing an assembly as claimed in claim 2, in which the conductor body (22) is introduced into the metal sheath (20).

8. The assembly as claimed in claim 1, wherein the conductor body (22) consists of glass.

9. The assembly as claimed in claim 8, wherein the conductor body (22) has a circular cross section and is surrounded by a metal sheath (20).

10. The assembly as claimed in claim 8, wherein the conductor body (22) has a diameter between 4 and 4.5 mm with a length between 8 and 20 mm.

11. The assembly as claimed in claim 8, wherein the adaptors (26, 30) consist of a plastic.

12. The assembly as claimed in claim 8, wherein the adaptors (26, 30) are captively held in the adaptor holders (24, 28).

13. A method of producing an assembly as claimed in claim 8, in which the conductor body (22) is introduced into the metal sheath (20).

14. The assembly as claimed in claim 8, wherein the conductor body (22) consists of quartz glass.

15. The assembly as claimed in claim 14, wherein the conductor body (22) has a circular cross section and is surrounded by a metal sheath (20).

16. The assembly as claimed in claim 14, wherein the conductor body (22) has a diameter between 4 and 4.5 mm with a length between 8 and 20 mm.

17. The assembly as claimed in claim 14, wherein the adaptors (26, 30) consist of a plastic.

18. The assembly as claimed in claim 14, wherein the adaptors (26, 30) are captively held in the adaptor holders (24, 28).

19. A method of producing an assembly as claimed in claim 14, in which the conductor body (22) is introduced into the metal sheath (20).

20. The assembly as claimed in claim 1, wherein the conductor body (22) has a circular cross section.

21. The assembly as claimed in claim 20, wherein the conductor body (22) has a diameter between 4 and 4.5 mm with a length between 8 and 20 mm.

22. The assembly as claimed in claim 20, wherein the adaptors (26, 30) consist of a plastic.

23. The assembly as claimed in claim 20, wherein the adaptors (26, 30) are captively held in the adaptor holders (24, 28).

24. A method of producing an assembly as claimed in claim 20, in which the conductor body (22) is introduced into the metal sheath (20).

25. The assembly as claimed in claim 20, wherein the metal sheath (20) consists of an alloy known as Hastelloy or an alloy with the material number 1.4571.

26. The assembly as claimed in claim 25, wherein the conductor body (22) has a diameter between 4 and 4.5 mm with a length between 8 and 20 mm.

27. The assembly as claimed in claim 25, wherein the adaptors (26, 30) consist of a plastic.

28. The assembly as claimed in claim 25, wherein the adaptors (26, 30) are captively held in the adaptor holders (24, 28).

29. A method of producing an assembly as claimed in claim 25, in which the conductor body (22) is introduced into the metal sheath (20).

30. The assembly as claimed in claim 1, wherein there is a press fit between the metal sheath (20) and the conductor body (22).

31. The assembly as claimed in claim 30, wherein the metal sheath (20) consists of an alloy known as Hastelloy or an alloy with the material number 1.4571.

32. The assembly as claimed in claim 30, wherein the conductor body (22) has a diameter between 4 and 4.5 mm with a length between 8 and 20 mm.

33. The assembly as claimed in claim 30, wherein the adaptors (26, 30) are captively held in the adaptor holders (24, 28).

34. The assembly as claimed in claim 30, wherein the adaptors (26, 30) consist of a plastic.

35. A method of producing an assembly as claimed in claim 30, in which the conductor body (22) is introduced into the metal sheath (20).

36. The assembly as claimed in claim 1, wherein the conductor body (22) has a diameter between 4 and 4.5 mm with a length between 8 and 20 mm.

37. The assembly as claimed in claim 36, wherein the adaptors (26, 30) consist of a plastic.

38. The assembly as claimed in claim 36, wherein the adaptors (26, 30) are captively held in the adaptor holders (24, 28).

39. A method of producing an assembly as claimed in claim 36, in which the conductor body (22) is introduced into the metal sheath (20).

40. The assembly as claimed in claim 1, wherein the adaptors (26, 30) consist of a plastic.

41. The assembly as claimed in claim 40, wherein the adaptors (26, 30) are captively held in the adaptor holders (24, 28).

42. A method of producing an assembly as claimed in claim 40, in which the conductor body (22) is introduced into the metal sheath (20).

43. The assembly as claimed in claim 40, wherein the adaptors (26, 30) consist of polytetrafluoroethylene.

44. The assembly as claimed in claim 43, wherein the adaptors (26, 30) are captively held in the adaptor holders (24, 28).

45. A method of producing an assembly as claimed in claim 43, in which the conductor body (22) is introduced into the metal sheath (20).

46. The assembly as claimed in claim 1, wherein the adaptors (26, 30) are captively held in the adaptor holders (24, 28).

47. A method of producing an assembly as claimed in claim 46, in which the conductor body (22) is introduced into the metal sheath (20).

48. The assembly as claimed in claim 46, wherein the adaptors (26, 30) are formed as stepped cylinders with a first portion and a second portion, the first portion in each case having a greater diameter than the second portion and the first portion in each case facing the conductor body (22).

49. A method of producing an assembly as claimed in claim 48, in which the conductor body (22) is introduced into the metal sheath (20).

50. A method of producing an assembly as claimed in claim 1, in which the conductor body (22) is introduced into the metal sheath (20).

51. The method as claimed in claim 50, wherein the metal sheath (20) is heated to such a temperature that its inside diameter is greater than the outside diameter of the conductor body (22), wherein the conductor body (22) is then inserted into the metal sheath (20) and wherein, finally, the metal sheath (20) is cooled, so that it shrinks onto the conductor body (22).

52. The assembly as claimed in claim 1, wherein the metal sheath (20) consists of an alloy known as Hastelloy or an alloy with the material number 1.4571.

53. The assembly as claimed in claim 1 further comprising an electronic device including a contact pin (10) and an antenna (18), the contact pin (10) radiating into a first waveguide (12) and the antenna (18) being connected to a second waveguide (16) and said assembly being arranged between the first and the second waveguides (12, 16).

* * * * *